United States Patent [19]

Chapman

[11] 4,389,816

[45] Jun. 28, 1983

[54] SHEET METAL PROTECTIVE COVER FOR AWNING WINDOWS

[76] Inventor: Ward W. Chapman, 2700 W. 3rd Ct., Hialeah, Fla. 33010

[21] Appl. No.: 247,221

[22] Filed: Mar. 24, 1981

[51] Int. Cl.[3] ..... E05B 65/04

[52] U.S. Cl. ..... 49/62

[58] Field of Search ..... 49/62

[56] References Cited

U.S. PATENT DOCUMENTS

| | | | |
|---|---|---|---|
| 2,170,110 | 8/1939 | Booth | 49/62 |
| 3,421,259 | 1/1969 | Egan, Jr. | 49/62 |
| 3,528,196 | 9/1970 | Luke | 49/62 |

*Primary Examiner*—Kenneth Downey

[57] ABSTRACT

A protective cover for the window sashes of awning windows is integrally formed of sheet metal and has a reversely-bent, lower marginal edge providing an inwardly-directed, shallow slot for the interhooking reception of the lower edge portion of the sash framework, and a substantially right-angular, inwardly-bent, upper marginal portion adapted to frictionally engage over the top of the window sash framework for retaining the protective cover in place. Upon full closure of the awning window, the upper portion of the covered sash framework locks behind the lower marginal portion of the next higher window sash, or the awning window frame header of the top sash, thereby securely retaining the protective cover.

2 Claims, 6 Drawing Figures

SHEET METAL PROTECTIVE COVER FOR AWNING WINDOWS

BACKGROUND OF THE INVENTION

This invention relates to awning windows, and is directed particularly to protective covers for the individual window sashes of awning windows for security and wind-storm protection.

It is common practice to enclose or "board-up" windows from the outside of a building to afford security protection against forced entry or break-in when the building is unoccupied, and to protect against breakage by flying objects during severe weather conditions such as occur during hurricanes and tornados. Plywood and sheet metal window covers heretofore used for this purpose are deficient in many respects, principally in that they are costly, difficult to install, and usually unsightly in appearance.

BRIEF SUMMARY OF THE INVENTION

It is, accordingly, the principal object of this invention to provide a novel and improved protective cover for awning windows that obviates the deficiencies of window covers heretofore devised.

A more particular object of the invention is to provide formed sheet metal covers for the individual window sashes of awning windows that can readily be installed and removed without the use of tools, and which, upon full closure of the awning window, interlock with adjacent covered sashes and the awning window framework to provide secure attachment even under the most severe hurricane wind conditions.

Another object of the invention is to provide a novel and improved protective cover for the individual sashes of awning windows that can be conveniently and inexpensively fabricated of sheet metal having a high metallic lustre, such as aluminum, thereby being well adapted to alternative use as a heat reflector in tropical and sub-tropical climates.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 5:
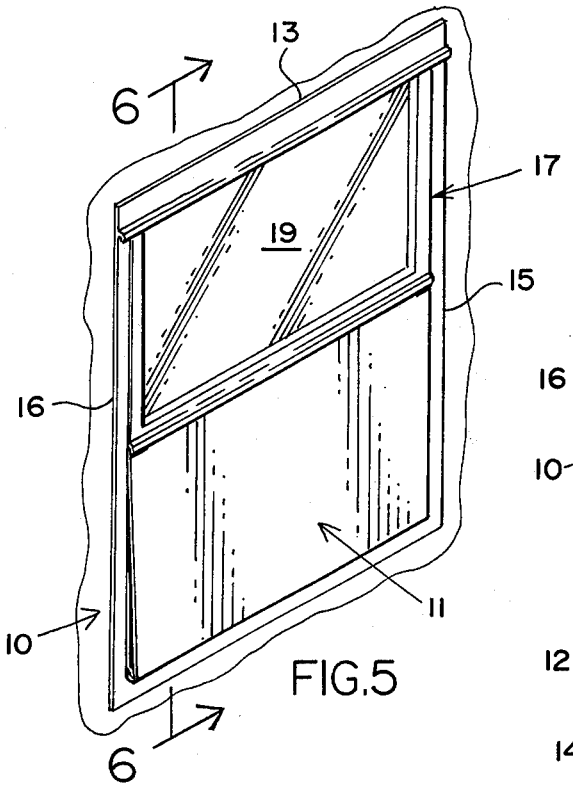
FIG. 5 is a perspective view similar to the perspective view of the awning window and protective cover assembly illustrated in FIG. 1, but with the window sashes closed.
Figure 1:
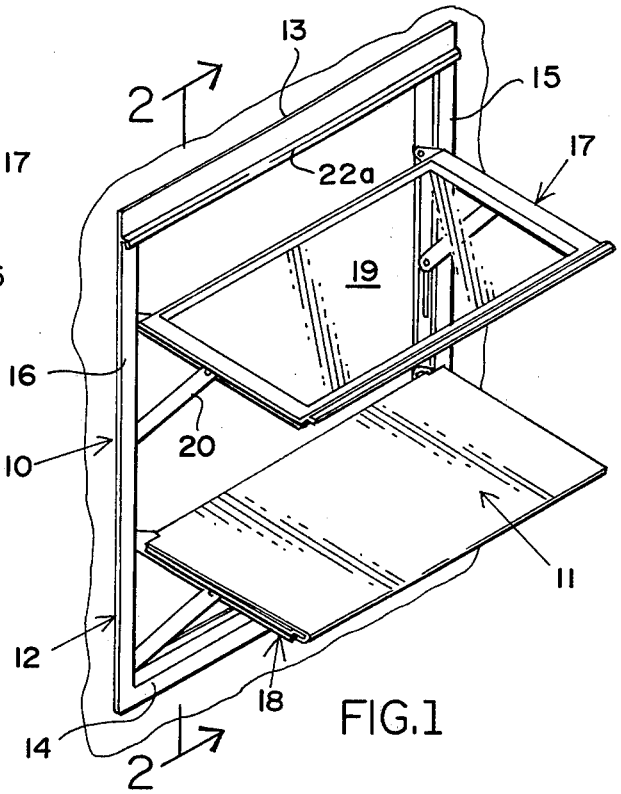
FIG. 1 is a perspective view, as seen from the outside, of a typical awning window having two open sashes and illustrating, by way of example, use of a protective cover embodying the invention assembled to the lower sash.
Figure 6:
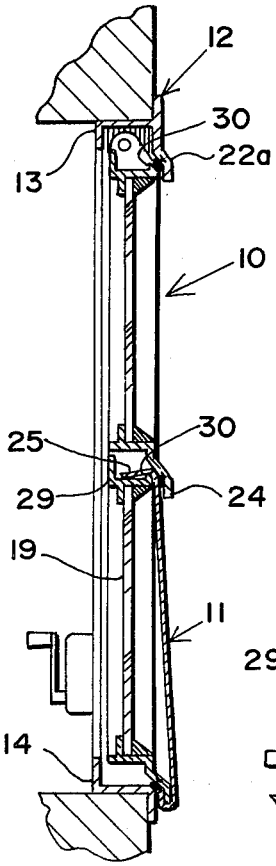
FIG. 6 is a vertical cross-sectional view taken along the plane indicated at 6—6 of FIG. 5 in the direction of the arrows, illustrating how overlapping upper and lower edges of the awning window sash framework serve to clamp the protective cover in place while at the same time performing their weather-sealing functions.
Figure 2:
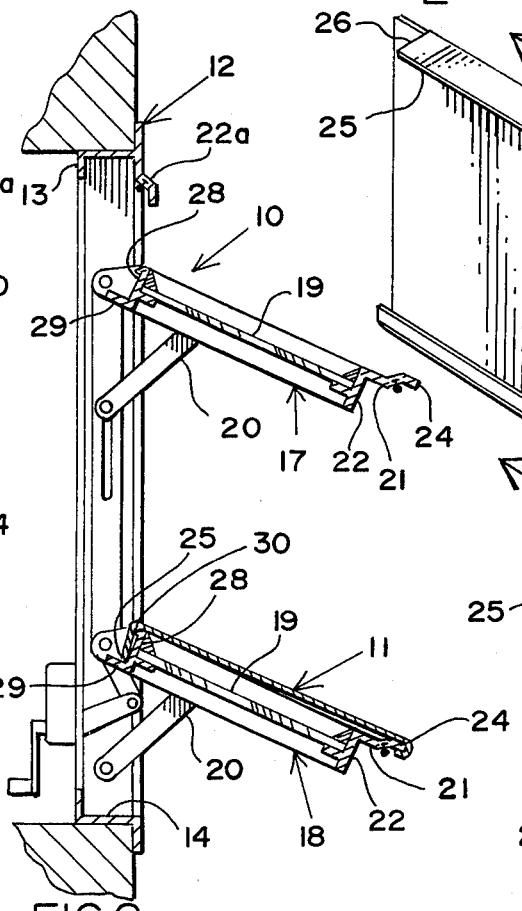
FIG. 2 is a vertical cross-sectional view taken along the plane indicated at 2—2 of FIG. 1 in the direction of the arrows.

Referring now in detail to the drawings, numeral 10 in FIGS. 1 and 5 designates, generally, a two-sash awning window, the lower sash of which is fitted with a sheet metal protective cover 11 embodying the invention. The awning window 10 to which the metal protective covers 11 embodying the invention are applied typically has a rectangular frame 12, fabricated of extruded aluminum parts including a window frame header member 13, window frame sill member 14 and side frame or stile members 15, 16, respectively. As best illustrated in FIGS. 1 and 2, the upper and lower window sashes 17 and 18, respectively, are also comprised of extruded metal parts assembled in a rectangular framework supporting the sash glass 19.

The window sashes 17, 18 are hinged at their upper ends between the window frame stile members 15 and 16 and pivotally connected with crank-controlled mechanism including lever arms 20 so that the window sashes can be moved between the open and closed positions illustrated, respectively, in FIGS. 1 and 5. Since various awning window opening and closing mechanisms of this type are well known, and are not claimed herein, it is not deemed necessary to describe the operating mechanism in greater detail. It need only be understood that upon full closure of the awning window sashes 17, 18, marginal side portions of the upper and lower window sash framework will overlap marginal outer side-wall portions of the window frame stile members 15, 16, and downwardly-projecting wall portions 21 of the bottom horizontal sash framework members 22 will overlap an upper marginal portion at the outside of either the next lower window sash framework or, if the bottom sash, the window frame sill member 14. Additionally, upon full closure of the awning window sashes 17, 18, they will be moved a short distance upwardly in the window frame so that an upper marginal front portion of the uppermost window sash framework passes behind a forwardly-projecting overhang or skirt portion **22*a* formed along the lower front edge of the window frame header member 13**. Weather stripping applied along these various overlapping surfaces upon closure of the awning window minimizes the possibility of air or water leakage when the awning window is fully closed.

Figure 3:
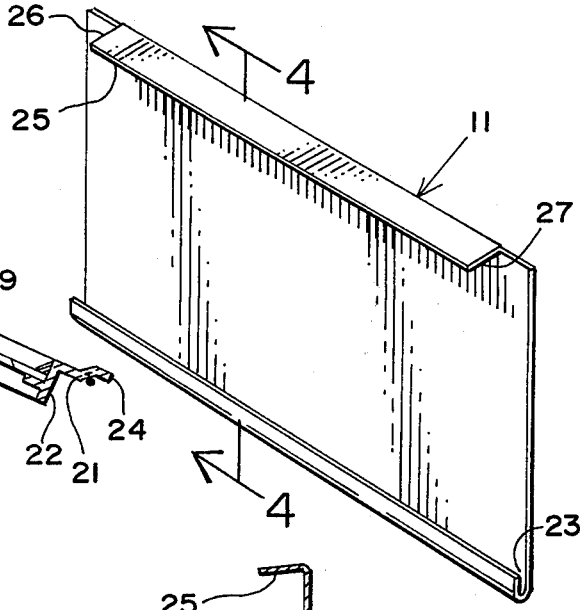
FIG. 3 is an oblique view of a sheet metal protective cover as viewed from the inside, shown separately.
Figure 4:
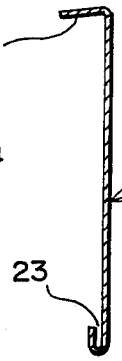
FIG. 4 is a vertical cross-sectional view of the protective cover, taken along the plane indicated at 4—4 of FIG. 3 in the direction of the arrows.

As best illustrated in FIGS. 3 and 4, the protective cover 11 will preferably be fabricated of sheet aluminum, rectangular in shape, the width being the same as the overall width of the particular awning window sash to be covered. The lower end of the protective cover is reversely bent therealong to provide a shallow groove 23 for the interhooking reception of the slightly outwardly offset weather strip supporting skirt 24 projecting downwardly of the downwardly projecting wall portions 21 of the bottom horizontal sash framework member 22 (see FIG. 2). An upper marginal portion 25 of the protective cover 11 is bent inwardly to define an angle of slightly less than 90 circular degrees with respect to the inner surface of said cover for frictional and interhooking connection at the top of the associated window sash, as is hereinafter more particularly described.

Opposed end portions of the protective cover upper marginal portion 25 are cut away, to provide recesses indicated at 26 and 27. The height of the protective cover 11 is just sufficient that, upon installation, after the skirt portion 24 of the awning window sash is fitted within the groove 23, the inwardly or rearwardly-projecting marginal portion 25 of said protective cover can be fitted over the horizontally extending ledge portion 28 of the upper awning window sash framework member 29. This ledge portion is integrally formed at its outer end and along its length with a short, upwardly-extending projection 30, over which the upper marginal portion 25 fits. It will be understood that the overall height of the protective cover 11 is preferably such that it is necessary, upon installation of the protective cover, to manually flex the marginal portion 25 upwardly over the projection 30 whereby it will be securely retained in place in interhooking and frictional engagement. The cut-outs or recesses, 26, 27 at each end of the marginal hook portion 25 provide clearance for the hinging mechanism between each side of the awning sash framework and the window sash frame member 12.

While I have illustrated and described herein only one form of sheet metal protective cover for awning window sashes comprising the invention, it is to be understood that this embodiment is presented by way of example only and not in a limiting sense. The invention, in brief, comprises all the embodiments and modifications coming within the scope and spirit of the following claims:

What I claim as new and desire to secure by Letters Patent is:

1. A protective cover for the window sashes of awning windows of the type having rectangular sashes mechanically linked with respect to a window frame for movement between open and closed positions and in the closed position of which upper portions of a sash framework locks behind the lower marginal portion of the next higher window sash or, if the top sash, behind a lower marginal portion of the awning window frame header, the combination comprising; a substantially rectangular sheet metal cover member, the lower marginal edge portion of said cover member being reversely bent to provide a shallow, upwardly-directed slot at one side of said cover member, said cover member having a substantially right-angular, upper marginal portion bent in the direction of said one side thereof, the spacing between the bottom of said slot and the underside of said substantially right-angular upper marginal portion being such that when the protective cover is fitted to an awning window sash by placing the lower marginal edge portion of the sash in said slot, said substantially right-angular bent portion fits in frictional abutment over the top edge of the window sash framework, said substantially right-angular, upper marginal portion of said cover member forming an angle of slightly less than 90 circular degrees with respect to said one side of said cover member, said cover member being integrally formed by bending of somewhat resilient sheet metal to provide for interhooking engagement of said upper marginal portion over the top edge of a window sash framework.

2. A protective cover for window sashes as defined in claim 1, wherein relatively short end portions of said substantially right-angular marginal portion of said cover member are cut away to provide recesses allowing clearance for linkage mechanism at each side of upper portions of the associated awning window framework interconnecting with the awning window frame.

* * * * *